US007322201B2

(12) United States Patent
Brunner et al.

(10) Patent No.: US 7,322,201 B2
(45) Date of Patent: Jan. 29, 2008

(54) ICE MAKING APPARATUS

(75) Inventors: Roger P. Brunner, Wind Gap, PA (US); Michael S. Yautz, Jr., Easton, PA (US)

(73) Assignee: Follett Corporation, Easton, PA (US)

( * ) Notice: Subject to any disclaimer, the term of this patent is extended or adjusted under 35 U.S.C. 154(b) by 0 days.

(21) Appl. No.: 11/422,107

(22) Filed: Jun. 5, 2006

(65) Prior Publication Data

US 2006/0201195 A1 Sep. 14, 2006

Related U.S. Application Data

(62) Division of application No. 10/794,119, filed on Mar. 4, 2004, now Pat. No. 7,096,686.

(51) Int. Cl.
*F25C 1/14* (2006.01)

(52) U.S. Cl. ..... 62/71; 62/320; 62/354

(58) Field of Classification Search ..... 62/71, 62/320, 354

See application file for complete search history.

(56) References Cited

U.S. PATENT DOCUMENTS

| | | | | |
|---|---|---|---|---|
| 3,245,225 A | | 4/1966 | Wallace | |
| 3,264,836 A | | 8/1966 | Miller et al. | |
| 3,662,564 A | * | 5/1972 | Clearman et al. | 62/320 |
| 3,869,875 A | | 3/1975 | Verlinden et al. | |
| 4,198,831 A | * | 4/1980 | Barnard et al. | 62/320 |
| 4,420,949 A | | 12/1983 | Bartholmey et al. | |
| 4,433,559 A | | 2/1984 | Spinner | |
| 4,574,593 A | * | 3/1986 | Nelson | 62/320 |
| 5,109,679 A | * | 5/1992 | Hida | 62/320 |
| 5,123,260 A | * | 6/1992 | Althoff et al. | 62/354 |
| 5,189,891 A | * | 3/1993 | Sakamoto | 62/354 |
| 5,460,014 A | | 10/1995 | Wang | |
| 5,884,501 A | | 3/1999 | Goldstein | |
| 5,911,749 A | * | 6/1999 | Sugie | 62/354 |
| 6,134,908 A | | 10/2000 | Brunner et al. | |
| 6,877,334 B2 | | 4/2005 | Hiramatsu | |

* cited by examiner

*Primary Examiner*—William E. Tapolcai
(74) *Attorney, Agent, or Firm*—Paul & Paul

(57) ABSTRACT

An ice making apparatus is provided in which a refrigeration cycle is used to produce ice inside an evaporator that is generally horizontally disposed, with a hollow auger being provided with a helical flight thereon, for scraping ice from the inner wall of the evaporator and pushing the ice toward one end of the auger, by which it is compressed and moved by a paddle toward a flange, in which it is delivered to an ice breakup device, by which the ice is diverted into a compression zone, with water being squeezed from the ice and the ice delivered to a transport tube and then to an ice retainer. Filling the retainer or jamming of ice nuggets inside the transport will effect a shut-down of the apparatus. Various water level controls for a water reservoir are provided, whereby the auger is flooded inside and outside, for enhancing ice formation. Nugget-type ice is provided by the ice making apparatus. The apparatus allows for changing the nugget size/shape without negative ice hardness consequences.

18 Claims, 12 Drawing Sheets

FIG.10
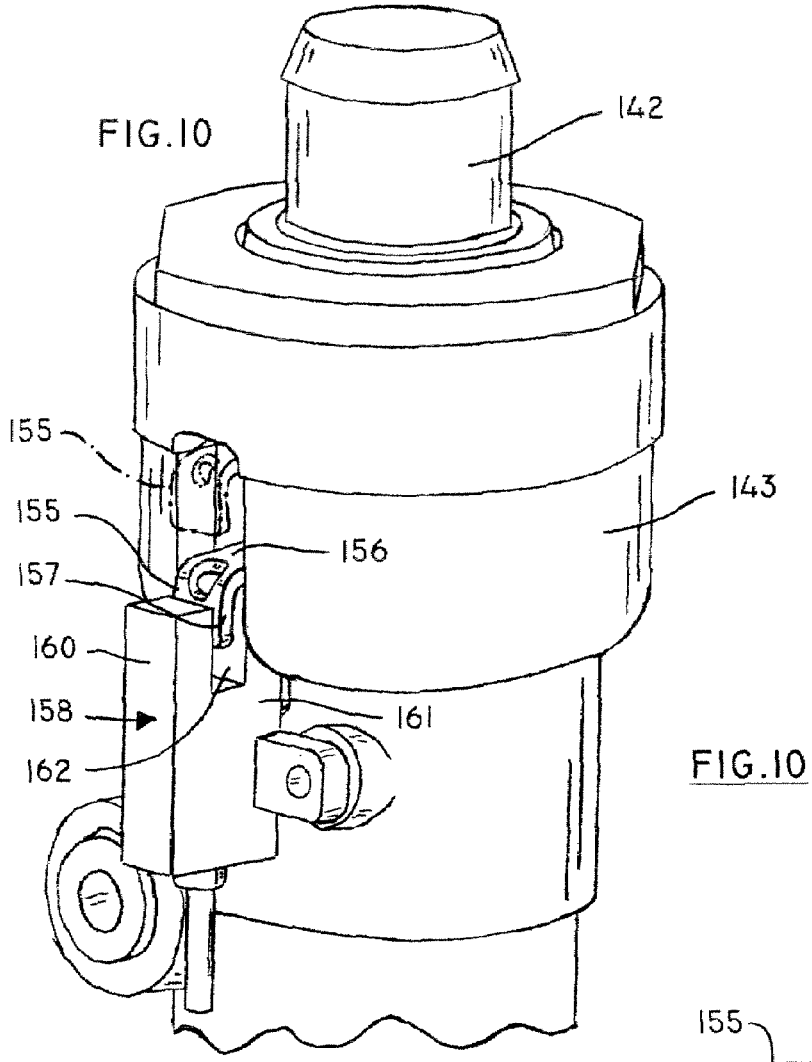
FIG.10
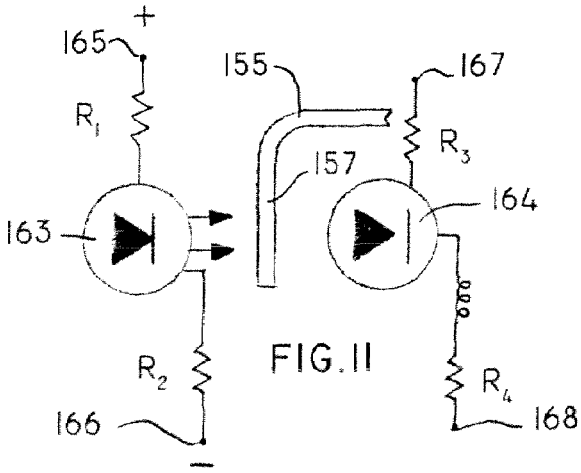
FIG.11
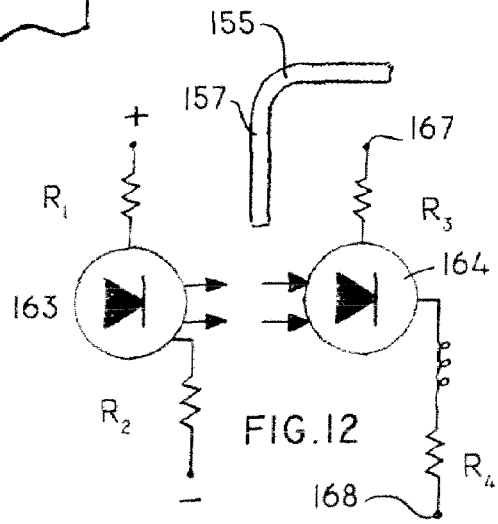
FIG.12

ICE MAKING APPARATUS

CROSS REFERENCE TO RELATED APPLICATION

This is a division of application Ser. No. 10/794,119, filed Mar. 4, 2004 now U.S. Pat. No. 7,096,686.

BACKGROUND OF THE INVENTION

This invention is directed to an ice making apparatus. Specifically, it is directed to an apparatus for making ice of the nugget-forming type, from ice shavings that are compacted.

Prior art apparatus and equipment for making ice of the nugget-forming type, from ice shavings that are scraped from a surface that, in turn, is refrigerated, so that water freezes on a refrigerated surface forming ice, which ice can be scraped from that surface to form ice shavings, and wherein those ice shavings are compacted to be nugget-forming, is known in the art. A representative such apparatus/system is disclosed in U.S. Pat. No. 6,134,908, the complete disclosure of which is herein incorporated by reference. Ice making apparatus and systems in accordance with U.S. Pat. No. 6,134,908, and other such apparatus and systems, are highly functional. Generally, such apparatus employs a refrigeration system for providing refrigerant to a freezing chamber of the hollow cylinder type. Typically, water is supplied to the freezing chamber and the water becomes frozen due to the refrigerant provided, generally via an evaporator component of a refrigeration system.

Typical of such apparatus, is that a rotatable ice auger fits inside the freezing chamber and is rotationally driven, such that flights of the auger scrape ice that is formed on a cylindrical wall of the freezing chamber. Typically, the ice is conveyed along the auger, to a location where it becomes compressed. The compressed ice is compacted into a solid form, and water is squeezed from it. The solid form ice is then delivered from the apparatus and becomes broken up into nuggets of solid form, prior to or during its delivery to a location of storage or use.

SUMMARY OF THE INVENTION

The present invention is directed to improving prior art ice making apparatus of the type in which ice of the nugget-forming type is made from ice shavings that are compacted.

One aspect of the improvement is to make the auger hollow, so that it can receive water therein. This provides a larger reservoir for water. With openings then provided through the wall of the hollow auger, it is possible to irrigate the entire refrigerated surface of the ice forming chamber and the auger exterior surface.

The present invention is a further improvement over the prior art, in that the auger is horizontally disposed so that cold water is able to flood the entire surface of the evaporator, rather than have ice blocking the migration of the water upward, as can occur with vertically disposed augers.

Another feature of the present invention is that the auger is provided with an ice-engaging leading surface on one side of the auger flight and a trailing surface on the other side of the auger flight, with such surfaces being beveled relative to each other and meeting in an ice-cutting generally helical edge facing toward one end of the freezing chamber.

Another inventive feature of the apparatus of the present invention is that the ice compression means that receives ice from the freezing chamber and compresses it into compacted solid from while squeezing water from it, includes a flange carried by the auger for rotation with the auger and extending generally radially outwardly of the auger, such that axial thrust loads that are generated during the compression of the ice are not transmitted to the bearings or mechanical structure of the evaporator. This also allows great amounts of water to be squeezed out of the ice during compression and minimizes axial compression of the ice during extrusion, while also minimizing the trapping of water within the nugget that is being formed.

Also, in accordance with this invention, an ice breakup device is provided whereby compacted solid form ice that is being conveyed toward the discharge end of the rotatable auger is broken up into smaller ice particles.

Additionally, the ice breakup device includes an ice diverter for diverting ice particles that are broken up, into an ice expansion chamber.

Furthermore, a paddle is provided that cooperates with a flange that is carried by the discharge end of the auger, to form and push ice into compacted solid form ice at the discharge end of the auger.

In accordance with the invention, the ice breakup device is located adjacent the rotatable flange and is statically positioned relative to the flange, whereby moving compacted solid form ice is contacted by the ice breakup device, with the paddle pushing compacted solid form ice toward the ice breakup device.

Also, in accordance with this invention, water that is squeezed from a compression nozzle into which broken up ice is delivered, is returned to the freezing chamber.

Furthermore, in accordance with this invention, the ice breakup device scrapes compacted solid form ice from the auger.

The present invention also includes a transport tube for receiving ice that has been compressed after being delivered from the freezing chamber, and wherein a sensor senses axial strain on the transport tube from ice buildup therein, with the sensor then causing a discontinuance of the auger rotation in response to the sensed axial strain.

In accordance with the apparatus of this invention a water reservoir is provided for supplying water to the freezing chamber in which the auger rotates, to scrape ice from a wall of the freezing chamber.

In addition to the water reservoir, high and low water level sensors control the amount of the water in the freezing chamber, by controlling the water delivery to the freezing chamber and the discharge of water from the freezing chamber, to maintain the level of water in the reservoir within prescribed upper and lower limits.

Accordingly, it is an object of this invention to provide an ice making apparatus for making ice of the nugget-forming type from ice that is scraped off a wall of a freezing chamber, with a refrigeration system being provided for providing refrigerant to the freezing chamber, and wherein one or more of the above-mentioned devices and features of the present invention are employed.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

Figure 2:
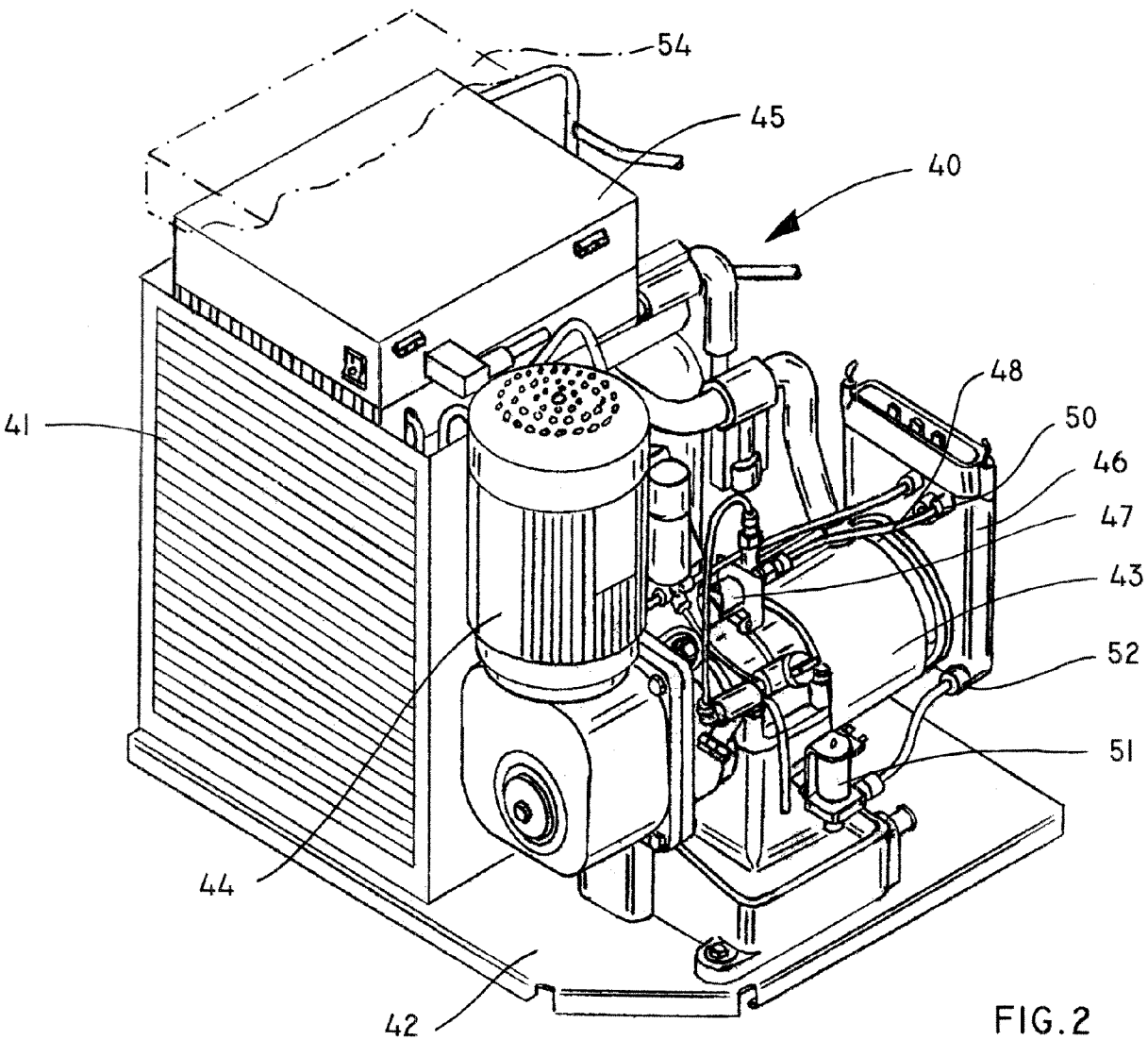
FIG. 2 is a top perspective view of an ice making apparatus in accordance with this invention.
Figure 3:
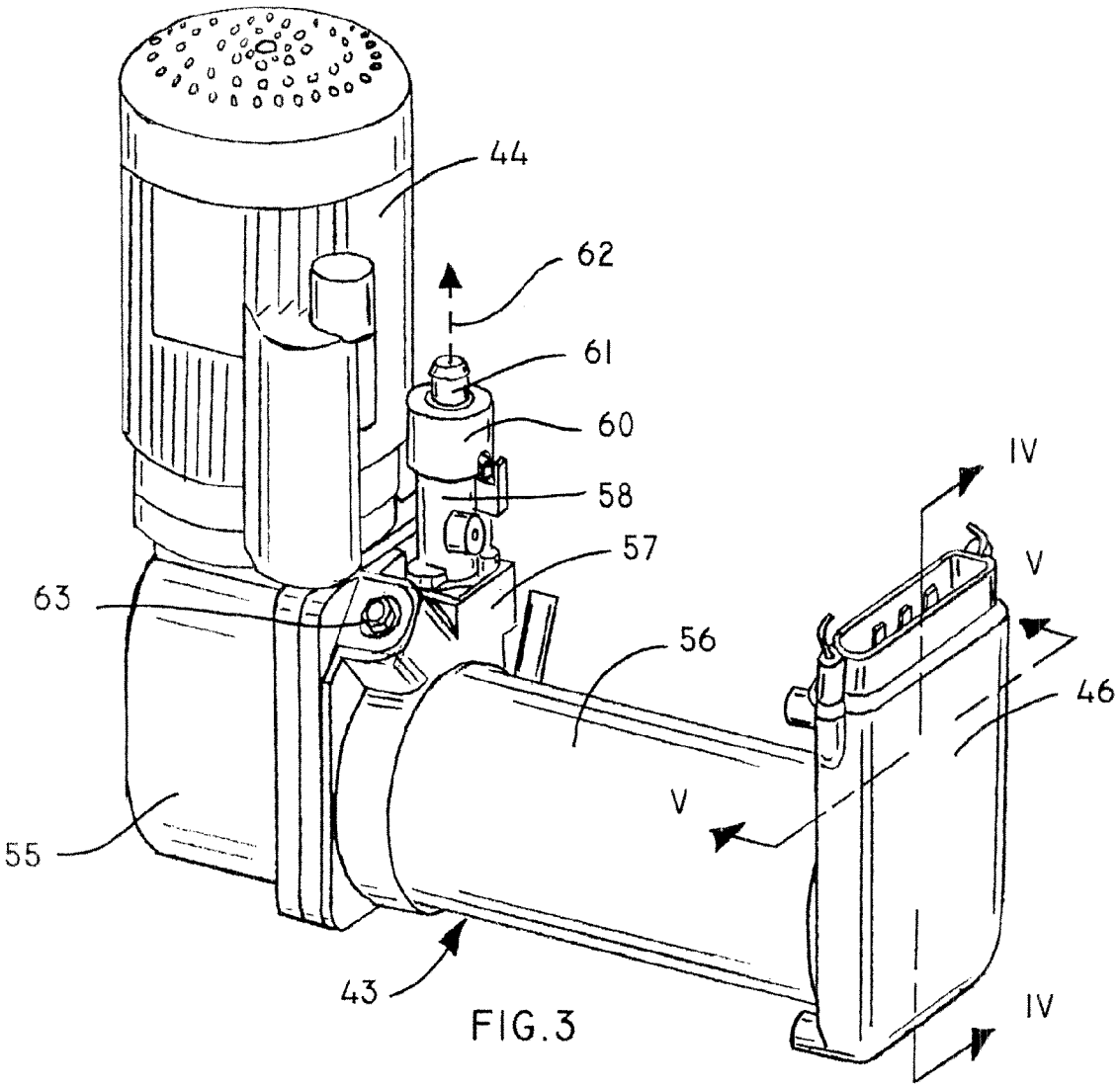

FIG. 3 is a top perspective view of a portion of the apparatus of FIG. 2, wherein the motor drive for the rotatable auger is shown, connected to the left end of the freezing chamber, with the freezing chamber being horizontally disposed and with an auger (not shown) present therein, and with a water feed reservoir for the freezing chamber being shown disposed at a right end of the illustration of FIG. 3.

Figure 4:
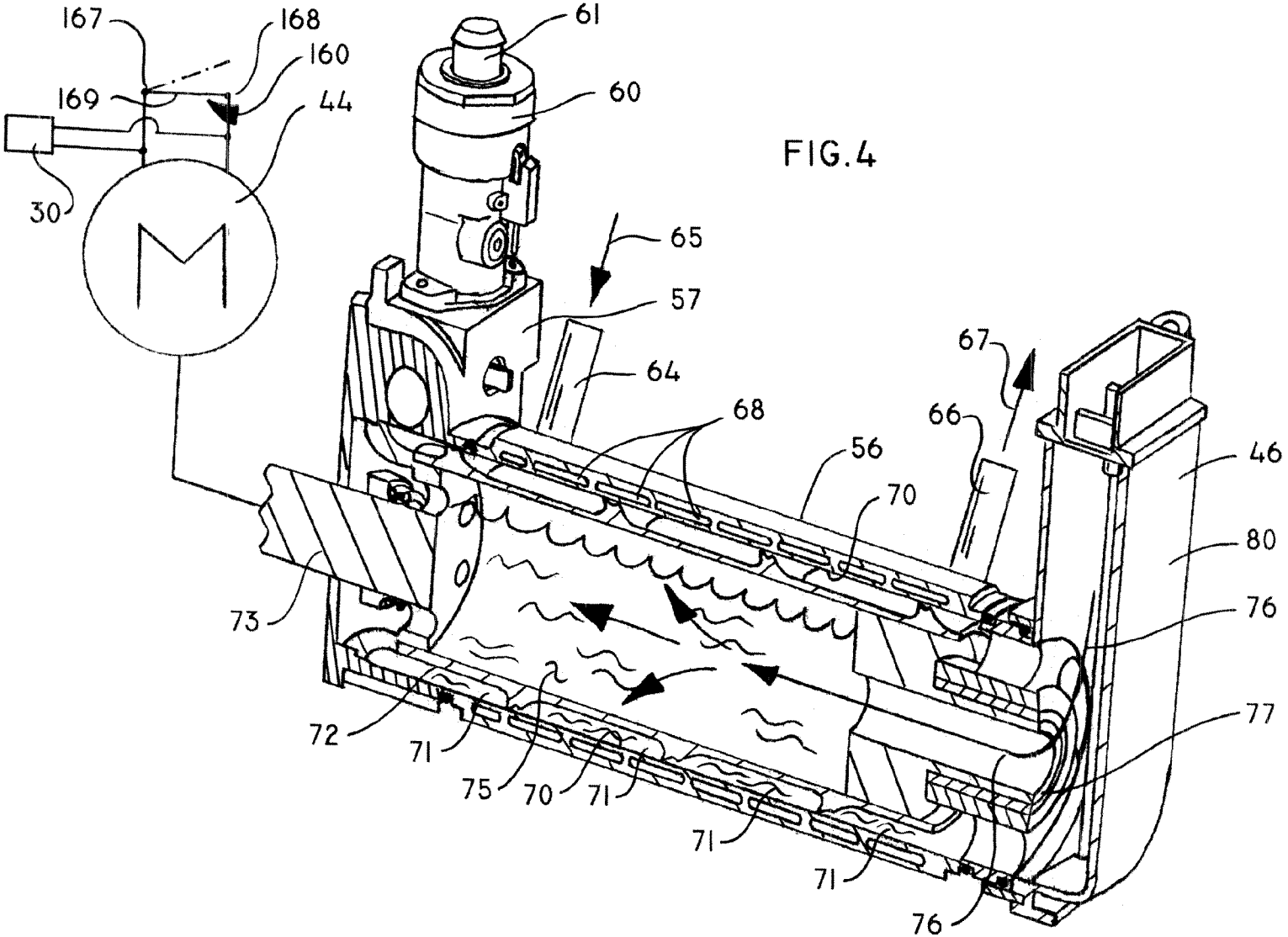

FIG. 4 is a vertical sectional view taken through the water reservoir and freezing chamber of FIG. 3, illustrating in vertical perspective section some of those components of the apparatus shown in FIG. 3.

Figure 5:
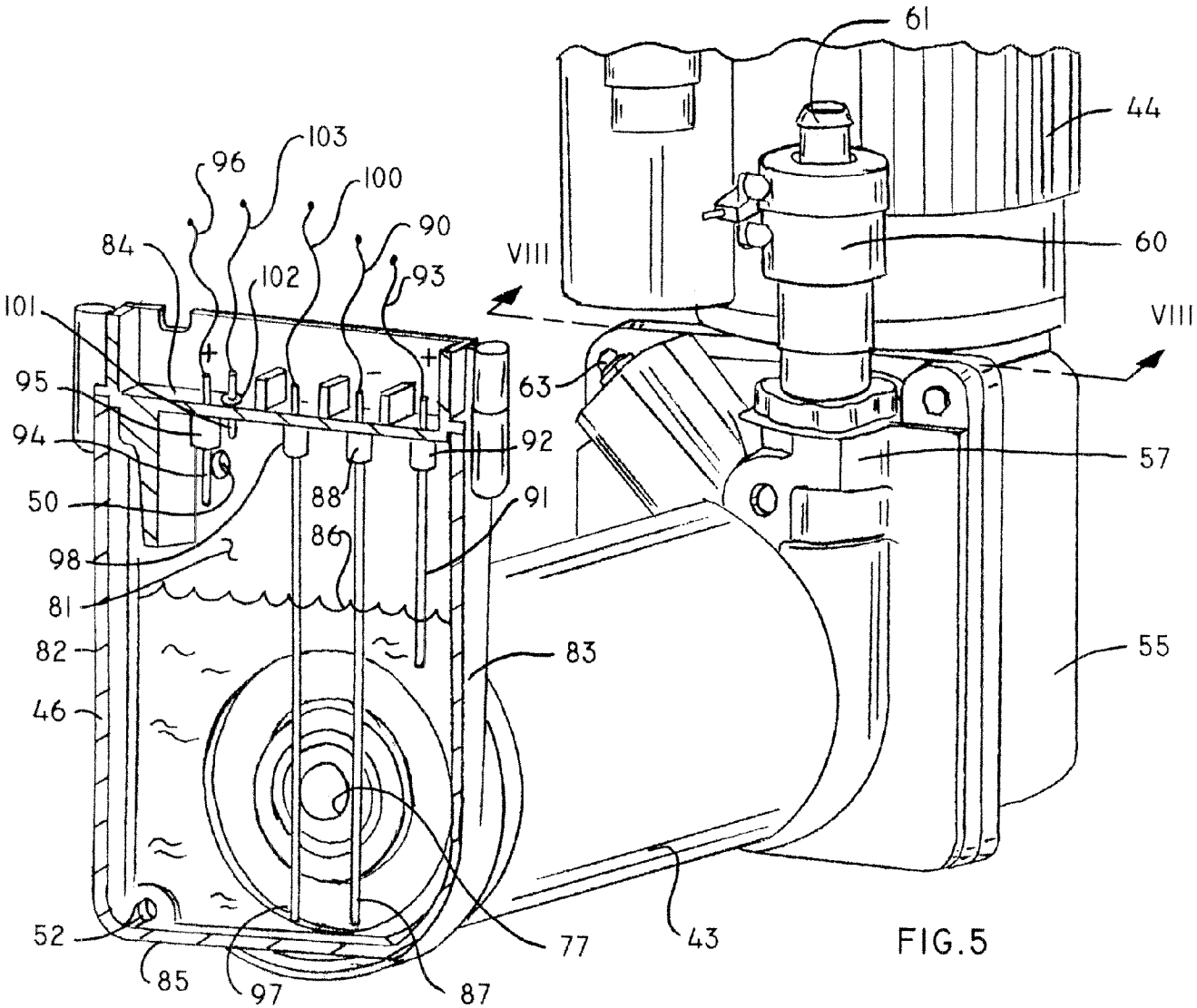

FIG. 5 is a perspective view of the exterior of the freezing chamber and motor drive for the auger, representing another angular view of the components shown in FIG. 3 with the reservoir being shown in section, with the section line being taken generally along the line V-V of FIG. 3.

Figure 6:
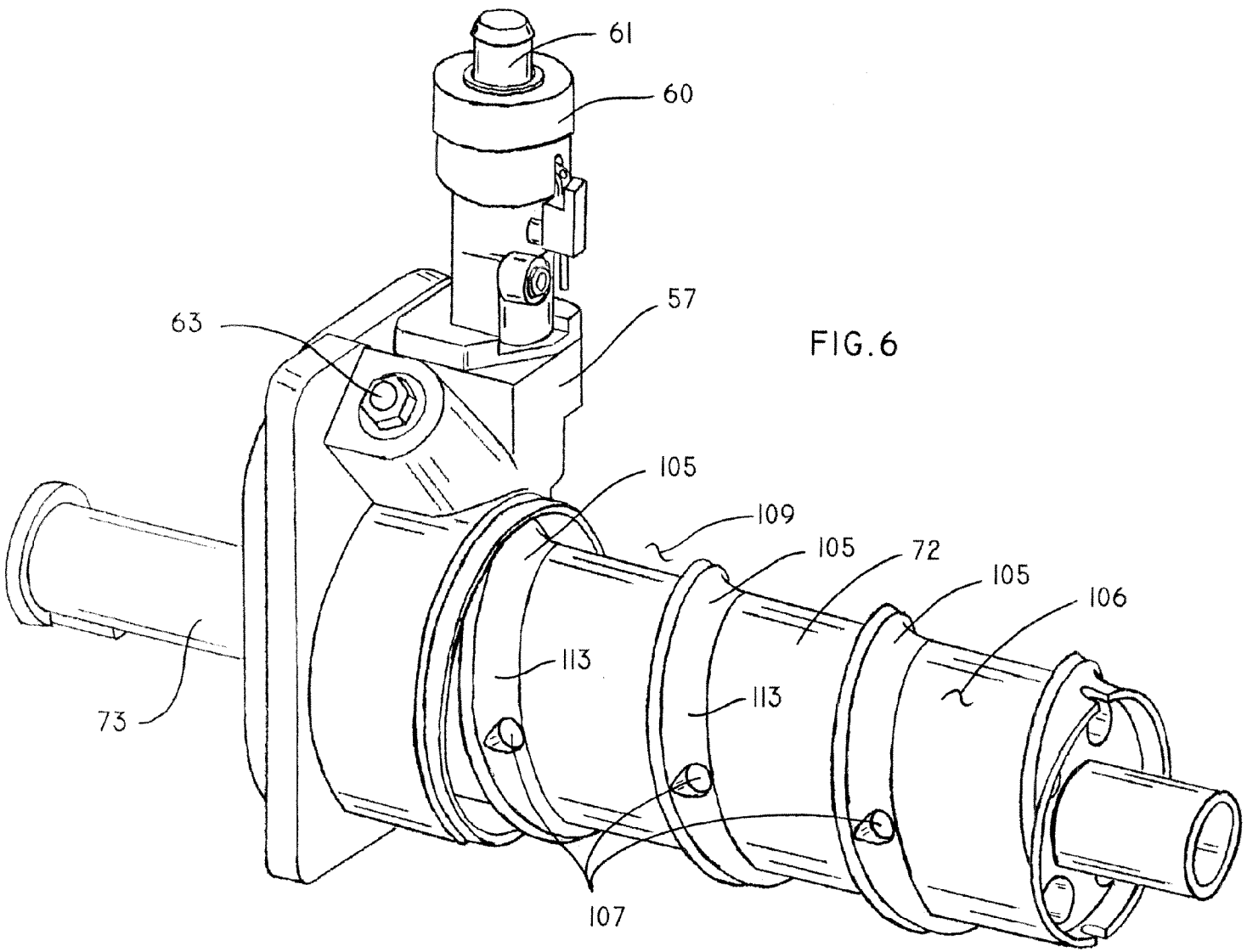

FIG. 6 is a top perspective view of the horizontal auger and the left end of the ice compression zone at the discharge end of the auger, with the freezing chamber removed for clarity of illustration.

Figure 7:
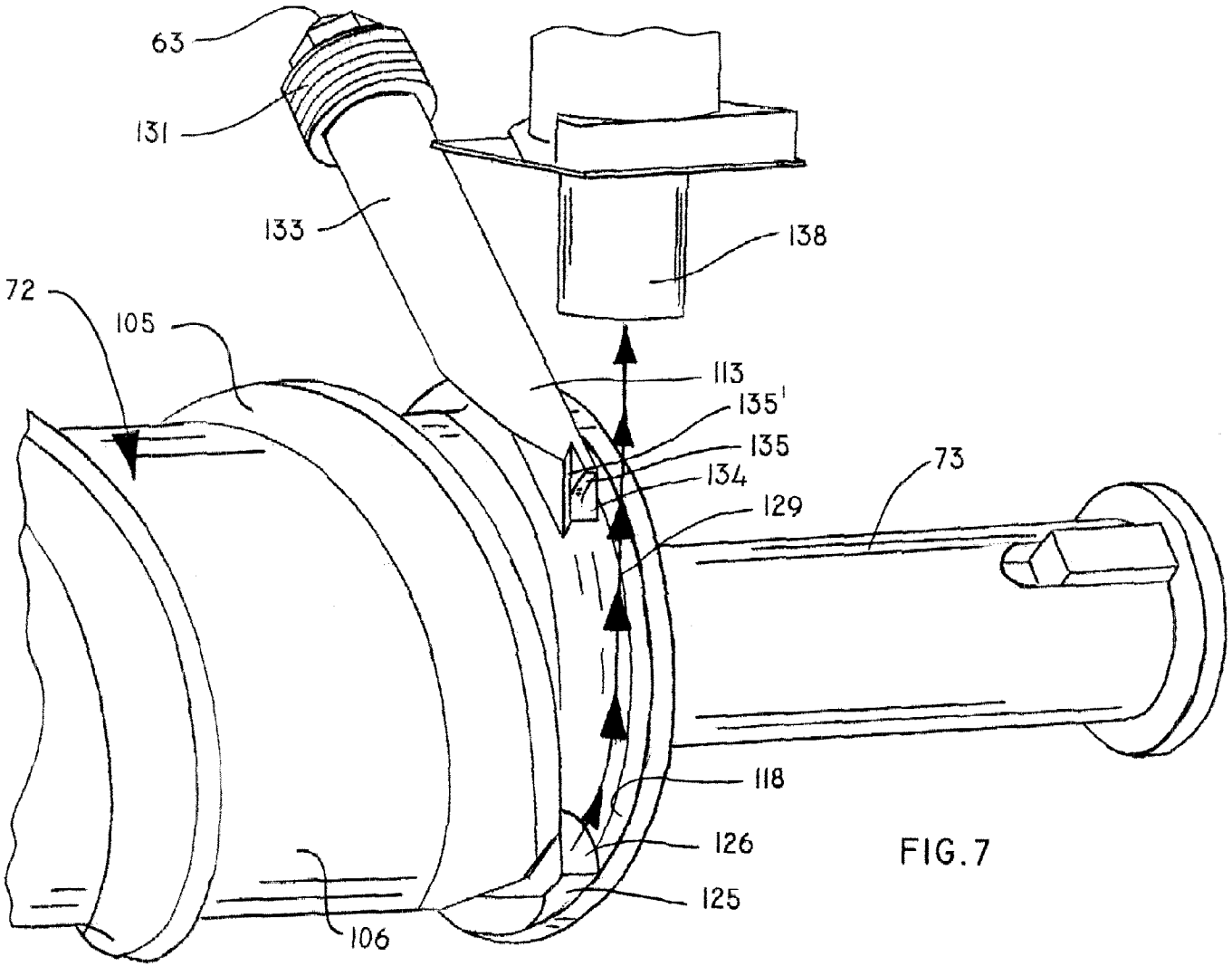

FIG. 7 is a fragmentary perspective view of the discharge end of the horizontal auger, with the freezing chamber removed for clarity of illustration, whereby a paddle is shown cooperating with the rotatable flange carried at the discharge end of the auger, to move ice in the direction of the arrow shown, toward the stationary ice breakup device, for breaking up ice that is compressed prior thereto into ice particles, to enter an expansion chamber, also shown in perspective.

Figure 8:
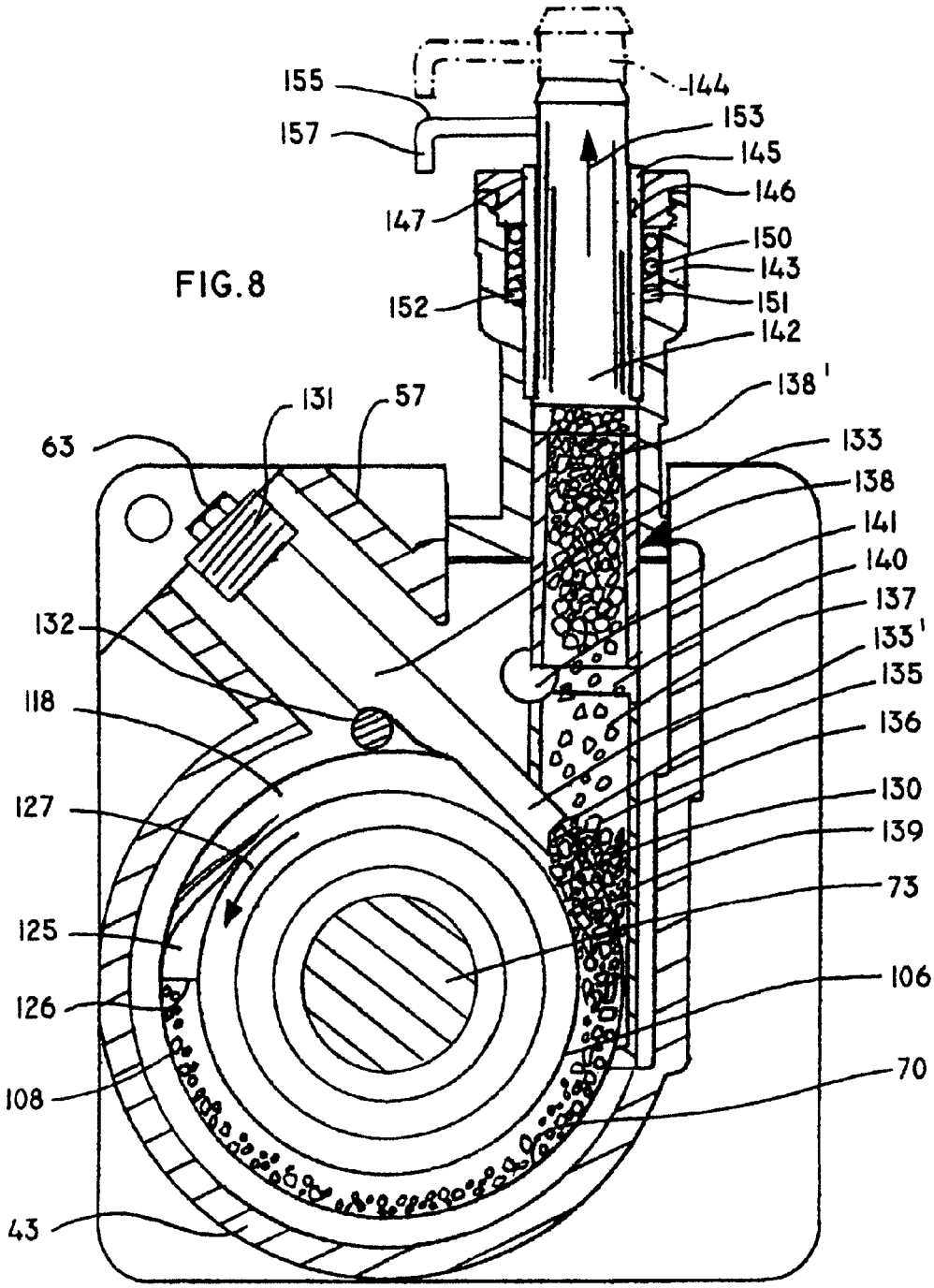

FIG. 8 is a vertical sectional view, taken through the discharge end of the freezing chamber and auger of this invention, and wherein the compression of ice being delivered to the stationary ice breakup device, prior to entering the expansion chamber and then the compression nozzle and ice transport, is more clearly illustrated.

Figures 9, 9A:
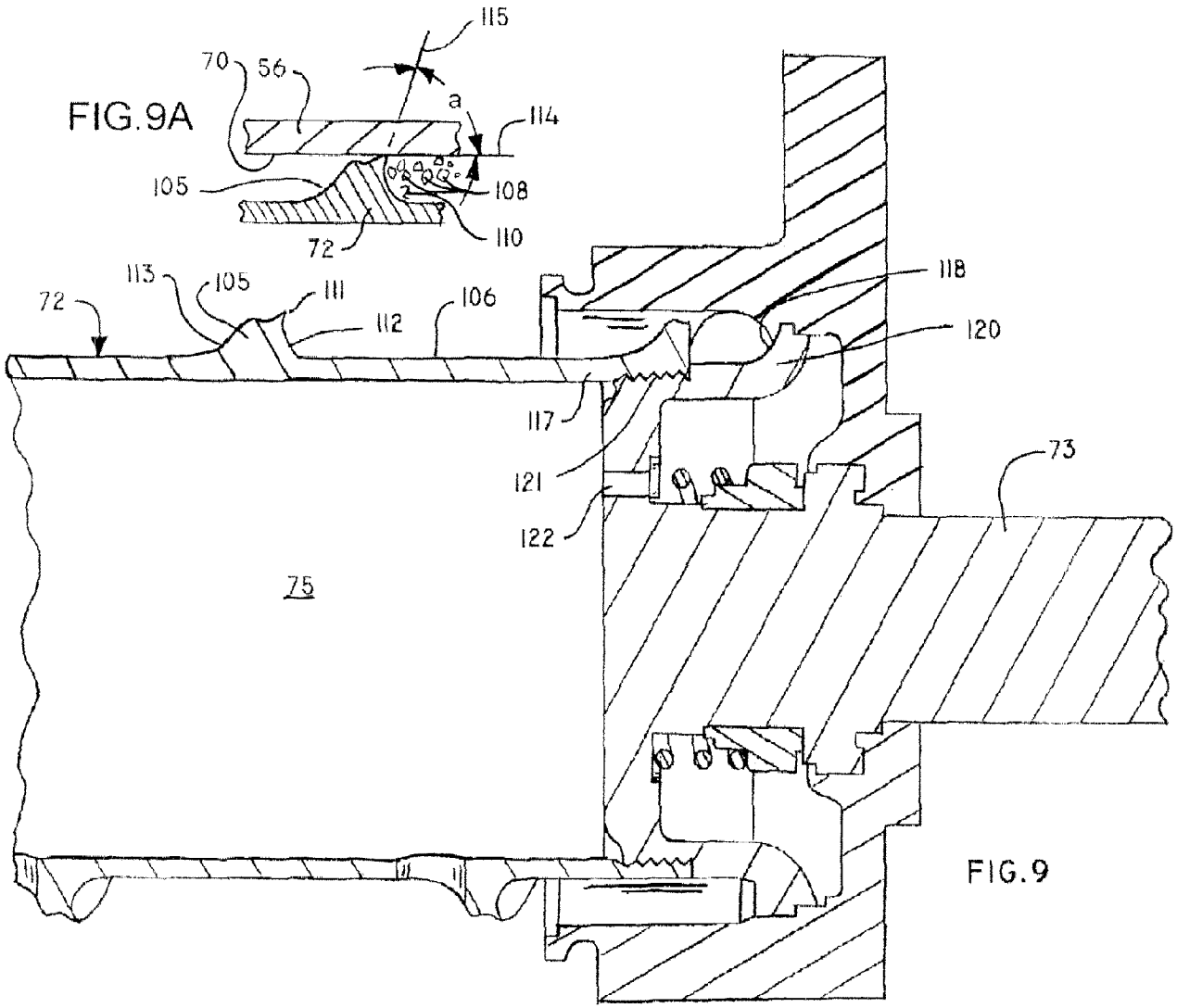

FIG. 9 is a vertical sectional view of the discharge end of the auger, its rotatable flange and auger flight, fragmentally shown, and with the freezing chamber removed from the illustration for the sake of clarity.

FIG. 9A is a fragmentary vertical sectional view, through an auger flight, shown as it scrapes ice from an interior wall of the freezing chamber.

Figure 9B:
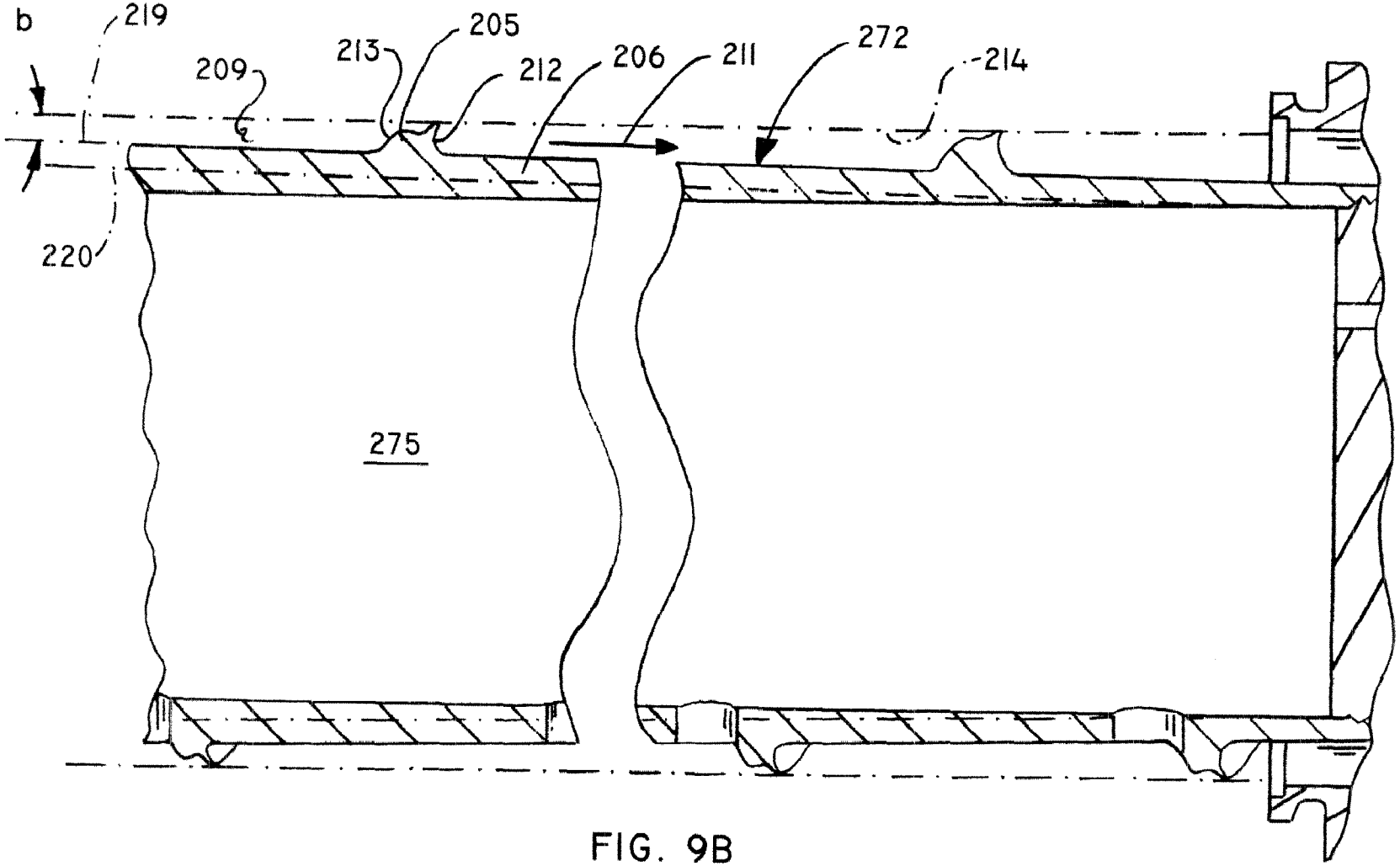

FIG. 9B is an enlarged fragmentary vertical sectional of a different embodiment for an auger to that of FIGS. 9 and 9A wherein the auger has a tapered outer cylindrical surface with a generally helical flight thereon.

FIG. 10 is an enlarged fragmentary illustration of an ice shuttle housing for the ice transport tube and the actuator for shutting down operation of the auger when ice backs up in the transport tube.

FIG. 11 is a schematic illustration of a photocell circuit, with the actuator disposed between the photocell sensor devices when the auger is in an operating, rotating mode.

FIG. 12 is an illustration similar to that of FIG. 11, but wherein the actuator has been removed from its presence between the photocell sensor devices due to ice buildup in the transport tube, and whereby the removal of the actuator caused by such buildup of ice allows the photocell sensor to shut down rotation of the auger.

Figure 13:
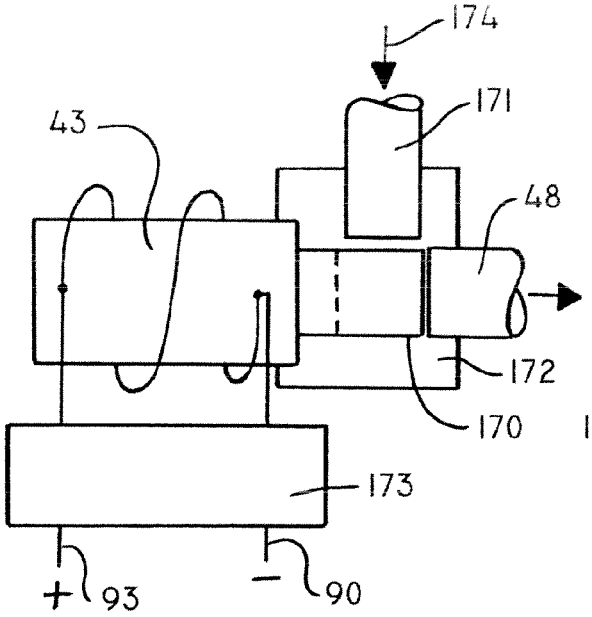

FIG. 13 is a schematic illustration of a means by which the water level in the reservoir is controlled, whereby the circuit between the normal low water detection rod and the common rod in the reservoir is complete, due to water in the reservoir being at a higher level than the lower end of the normal low water detection rod, such that the solenoid controlling the water inlet to the reservoir is shown in a full line in a position whereby water inlet to the reservoir is blocked, and whereby the blockage is removed, (shown in phantom) when water is desired to enter the reservoir inlet line, when the circuit between the normal low water rod and the common rod in a reservoir is opened due to water level dropping below the lower end of the normal low water level rod.

Figure 14:
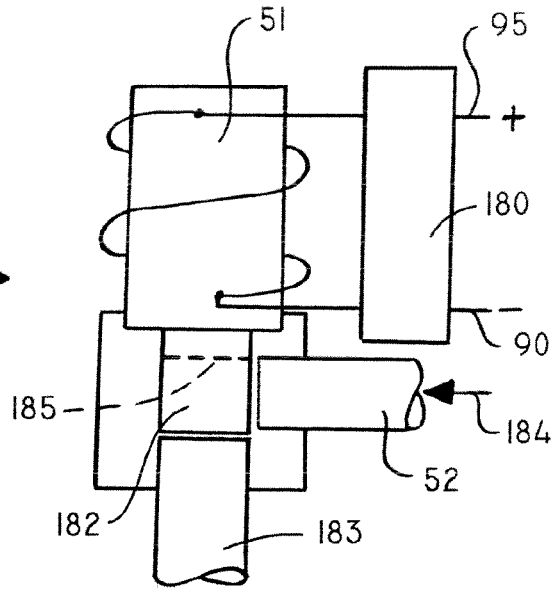

FIG. 14 is an illustration similar to FIG. 13, but wherein the water drainage from the reservoir is schematically illustrated, such that the solenoid is in a normally closed (full line) position, blocking water from discharge from the reservoir, and wherein the solenoid is movable such that its water blockage member can be moved to the phantom position shown in FIG. 14, whereby water can be discharged from the reservoir, should the water level in the reservoir reach a normal high water level rod, such that the circuit is completed between that rod and the common rod in the reservoir.

Figure 15:
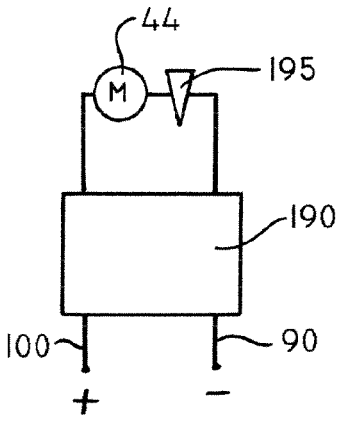

FIG. 15 is a schematic illustration of the method by which the electric circuit between the low water level alarm rod and the common rod is opened when water level in the reservoir extends below the lower end of the low water level alarm rod, such that, when that happens, the motor M that drives the auger is electrically disengaged to stop rotation of the motor, and an alarm is optionally provided for providing an audible signal to nearby operators simultaneously therewith.

Figure 16:
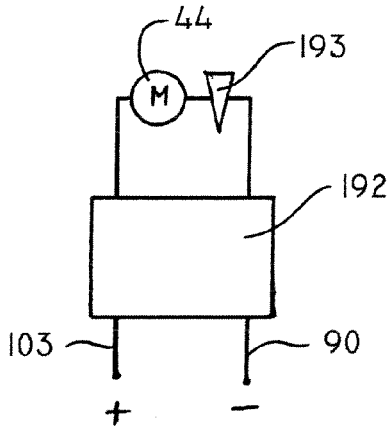

FIG. 16 is an illustration similar to that of FIG. 15, wherein a high water level alarm rod has the electric circuit between it and the common rod in the reservoir completed, such that the motor M that drives the auger is caused to be electrically disconnected, such that rotation of the auger ceases in that event, and wherein there is optionally provided an alarm in the circuit when that occurs, for providing an audible signal to nearby operators simultaneously therewith.

DETAILED DESCRIPTIONS OF THE PREFERRED EMBODIMENTS

Figure 1:
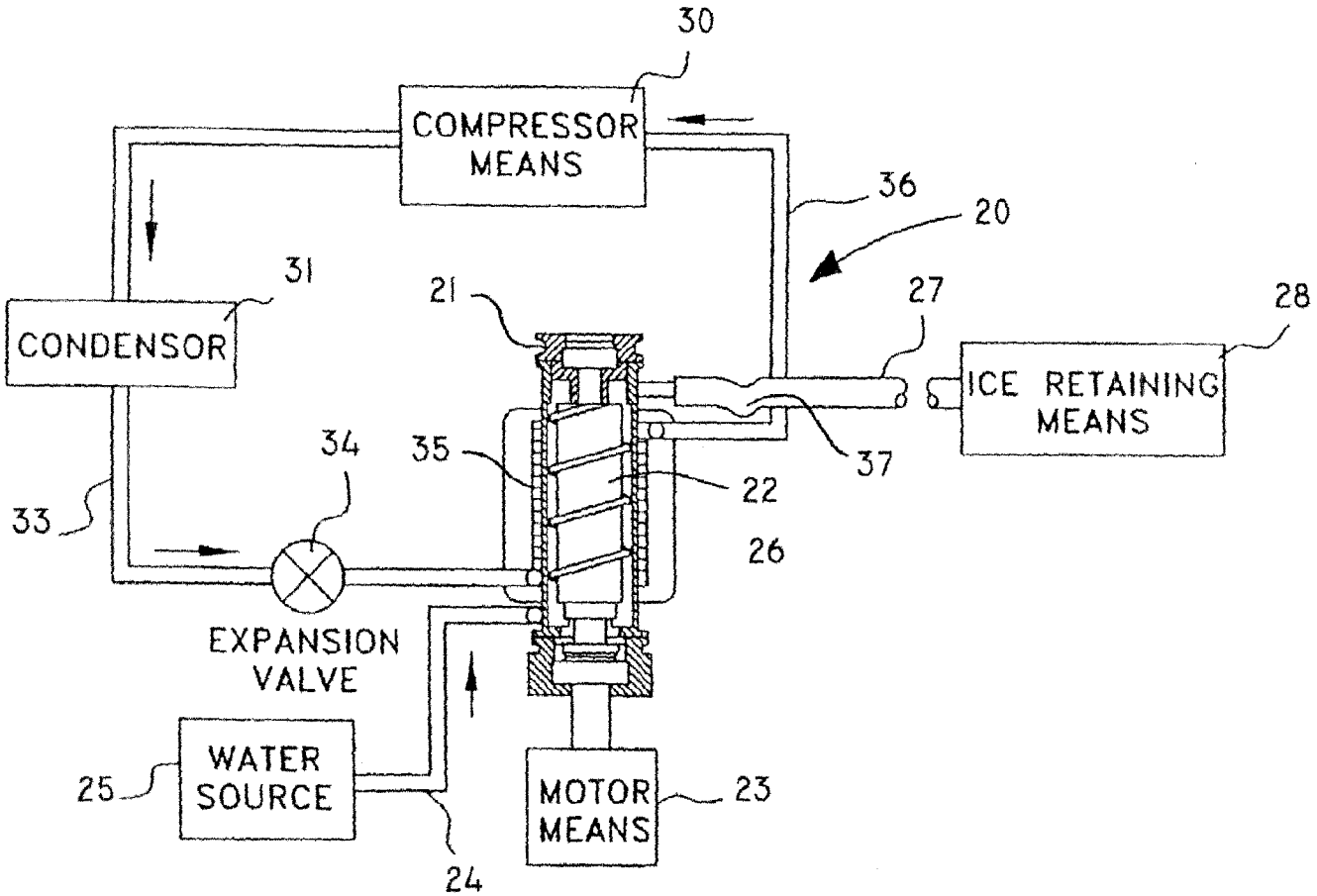
FIG. 1 (PRIOR ART)
FIG. 1 is a schematic illustration of an ice making apparatus for making ice of the nugget-forming type from ice shavings that are compacted, in accordance with the prior art.

Referring now to the drawings in detail, reference is first made to FIG. 1, wherein a prior art ice making apparatus is illustrated of the type from U.S. Pat. No. 6,134,908, the system of which is designated generally by the numeral 20 as comprising an auger-type ice generating apparatus 21, a rotating auger 22 which is driven by a motor 23, with a water inlet line 24 provided from a water source 25, which water becomes frozen within the ice generating apparatus 21, due to the auger 22 scraping ice from the inner wall of the hollow ice-forming chamber 26, and with an outlet delivery line 27, for delivering ice from the ice maker 21 to an ice retaining means 28 of the hopper or other type.

A water refrigeration means for forming ice on the inner wall 26 of the ice generating apparatus 21 is provided, in the form of a compressor 30, a condenser 31, with appropriate refrigerant conduit line 32 interconnecting the compressor and condenser, and with a refrigerant conduit line 33 delivering the refrigerant through an expansion valve 34 to an evaporator 35, by means of which refrigeration is provided to the ice generating means 21. The compressor means, condenser means, evaporator and expansion valve that comprise the refrigeration means can be as disclosed in U.S. Pat. Nos. 3,126,719 or 3,371,505, or of any other types. The ice retention means 28 can be as shown in U.S. Pat. No. 5,211,030 or of any other types.

It will be understood that the ice retaining means 28 may be disposed at a location that is remote from the ice generating apparatus 21, or nearby the ice generating apparatus 21, as may be desired, and that the delivery line or transport tube 27 is shown broken to indicate that the length or span of tube 27 may be substantially long to accommodate delivery of ice formed in the ice generating apparatus 21 to an ice retaining means 28 a considerable distance away from the generating means 21.

Refrigerant exiting the evaporator 35 may be returned to the compressor 30, via a refrigerant return line 36.

The ice transport line 27 may have one or more bends therein, at 37, such that ice exiting the ice making apparatus 21, in the form of compacted solid formations of ice scrapings with water squeezed therefrom, may be broken into ice nuggets.

The system described above for FIG. 1 may be as described in more detail in U.S. Pat. No. 6,134,908, the complete disclosure of which is herein incorporated by reference, or any other otherwise suitable type.

Referring now to FIG. 2, a general arrangement for the ice making apparatus of this invention generally designated by the numeral 40, is shown, as comprising a combination compressor/condenser unit 41, carried on a baseplate 42, and with an evaporator/gearmotor assembly 43, horizontally disposed and mounted on the baseplate 42, with an auger drive motor 44 being provided for driving the auger disposed within the evaporator 43 from the left end, as shown in FIG. 2. An electric control box 45 is shown, mounted above the compressor/condenser unit 41, for providing electrical controls to the various solenoids, switches and other items that will be discussed hereinafter.

A water reservoir 46 is provided at the right end of the illustration of FIG. 2, rightward of the evaporator/gearmotor assembly 43. The reservoir 46 holds water for feeding to the freezing chamber (not shown) that is disposed inside the evaporator 43.

A water feed solenoid 47 provides electrical control for feeding water via line 48 into the evaporator, at 50, as shown in FIG. 2.

A drain solenoid 51 is provided, for causing water to be drained from the reservoir 46 when an appropriate signal calls for the same, such water to be drained from the lower end of the reservoir 46, via drain line 52 generally to discharge.

The entire ice making apparatus 40, as shown in FIG. 2 may be sized and configured, to fit under a counter 54, fragmentally shown in phantom. The counter 54 may be disposed, as may be desired, at the height above the floor on which the baseplate 42 is mounted, to be of conventional lunch counter height or the like as may be desired.

With reference now to FIG. 3, certain components of the system illustrated in FIG. 2 will now be described in greater detail.

The evaporator/gearmotor assembly 43 is shown as comprising a gearmotor housing 55, an evaporator housing 56, a motor 44 for operating the driving gears and the like disposed within the gearmotor housing 55, for rotating an auger (not shown in FIG. 3) disposed within the evaporator housing 56. The water reservoir for the ice forming means located inside the evaporator 56, is shown at 46, at the right end of the illustration of FIG. 3.

An ice handling housing 57 is shown at the left end of the evaporator housing 56, in which ice is delivered up through a compression nozzle (not shown) disposed therein, through a shuttle housing 60, and out through a transport tube coupling 61, to be delivered therefrom through a continuation of the transport tube 27 in the direction of the arrow 62 to an ice retaining means 28.

A static ice diverter 63 is shown at the left end of the apparatus as shown in FIG. 3, which diverter 63 will be discussed in more detail herein.

With reference now to FIG. 4, it will be seen that the evaporator unit 56 receives refrigerant through the refrigerant inlet line 64, in the direction of the inlet arrow 65, with refrigerant being discharged from the evaporator 56 via refrigerant discharge line 66, in the discharge direction of the arrow 67, whereby refrigerant is delivered from the refrigerant discharge line 66 back to a compressor, through a condenser, through an expansion valve, and back to the refrigerant inlet 64, all in a generally continuous cycle as is conventional with refrigeration systems.

The refrigerant may be Freon, or any other suitable refrigerant, which will flow through the evaporator, via a generally helical passageway extending from the inlet 64, to the outlet 66, such helical passageway being shown at 68, for example, to provide sufficient coolant to the interior of a generally cylindrical wall surface 70, such that water that is present at zones 71, outside the auger 72 may become frozen on the wall surface 70.

The auger 72 is rotationally driven via the motor 44, as is schematically shown at the left end of FIG. 4, such that the auger drive shaft 73, which is fixedly mounted to the auger 72, causes the auger to be rotationally driven inside the cylindrical surface 70 of the ice making apparatus, as shown.

It will be understood that the auger 72 is generally horizontally disposed as shown in FIG. 4 and has a hollow cylindrical interior at 75 as shown.

The auger 72 is shown flooded with water in its interior 75 with the water flowing freely from the reservoir 46 therein, in the direction of arrow 76, down through the bushing 77 that mounts the right end of the auger 72, as shown, into the interior 75 of the auger 72. This water from the reservoir 46 also freely flows to the zones 71 between the outer cylindrical surface of the auger 72 and the interior cylindrical surface 70 of the ice making apparatus, such that the evaporator that surrounds the same can cause the water in zones 71 that are adjacent the cylindrical surface 70, to form ice, which the auger 72 may then scrape from the surface 70, as will be describe hereinafter.

With reference now to FIG. 5, it will be seen that the water reservoir 46 is illustrated in section, such that its various components may be illustrated.

The reservoir 46 is comprised of front and back walls 80 and 81, respectively, with left and right generally vertical side walls 82 and 83 as shown in FIG. 5, and with upper and lower walls 84 and 85 respectively, to contain water therein. A water inlet is provided at 50, and a water outlet is provided at 52.

A plurality of electrically operated rods are provided for the water reservoir 46, for controlling the water level shown at 86, therein. An electric rod 87 is shown, which functions as an electrically common rod, carried by the top wall 84 via a suitable insulator 88, with the upper end of the rod 87 having an electric wire connection 90 thereto.

A normal low water level rod 91 is carried by the top wall 84, through an insulator 92, and has an electrical lead wire 93 connected thereto, as shown. The lower end of the rod 91 is normally disposed in water, and is below the water level 86 as shown in FIG. 5. A normal high water level rod 94 is shown, carried by the top wall 84, through insulator 95, and has an electric wire lead 96 connected thereto.

A low water level alarm rod 97 is shown, carried by the top wall 84, through its insulator 98, and has an electric wire lead 100 connected thereto.

A high water level alarm rod 101 is shown, carried by the top wall 84, through its insulator 102, and has an electric wire lead 103 connected thereto.

Further details of construction of the auger 72 will now be described, with specific reference to FIGS. 6 and 9.

The auger 72 has a helical flight 105 carried by its cylindrical surface 106, extending radially outwardly therefrom.

The helical flight 105 generally comprises one continuous flight from the right end of the auger 72 as shown in FIG. 6, to the left end thereof, but could, alternatively, comprise a plurality of generally parallel arranged helical flights if desired.

With reference to FIGS. 9 and 9A, in particular, it will be seen that the helical flight 105 scrapes ice from the inner cylindrical wall surface 70 inside the evaporator 56, such that ice particles 108 in the ice-forming chamber 110 are scraped from the cylindrical wall surface 70, as ice shavings, having formed on the wall surface 70 due to the cooling effect provided by the evaporator 56 on water in the ice forming chamber 110. Thus, the scraping edge 11 that actually engages the shavings formed on the cylindrical surface 70 comprises the upper end of a leading ice-engaging surface 112 to the right of the auger helix 105 as shown in FIGS. 9 and 9A. The auger helix 105 also has a trailing surface 113 on the other side of the flight 105. It will be seen that the leading and trailing surfaces are beveled relative to each other, defining a cutting edge 111 that is forwardly, (or rightwardly) facing as shown in FIGS. 9 and 9A, to define an angle between the horizontal line 114 representing the surface 70 of the cylindrical member on which ice shavings form and an extension line 115 of the surface 112, as is shown most particularly in FIG. 9A, which lines 114 and 115 have an included angle "a" therebetween that is less than 90°. This enables a cutting of the shavings from the surface 70 as shown in FIGS. 9 and 9A, rather than a plowing of ice in a forward or rightward direction.

It will be noted from FIG. 9 that the leading surface 112 is generally concave in longitudinal cross-section, as shown in FIGS. 9 and 9A, and that the trailing surface 1 13 of the auger flight 105 is generally convex as shown in longitudinal cross-section in FIGS. 9 and 9A.

The auger 72, at its right-most end 117 as shown in FIG. 9, carries a flange 118 for rotation therewith, with the flange 118 being carried by a flange member 120 that is fixedly carried at the right end 117 of the auger 72, by means of a fixed, threaded connection 121 therewith.

As ice is moved forward, or rightward, as shown in FIGS. 9 and 9A, with the auger flight 105 compressing ice particles toward the flange 118, it will be noted that, with the flange 118 being carried with the auger 72, at its discharge end 117, as shown, in threaded engagement therewith as at 121, so that it fixedly moves with the auger, the flange 118 provides a means for absorbing axial thrust resulting from ice compression between the flight 105 and the flange 118, which is an improvement upon other systems in which ice is compressed against a separate compression head that does not travel with the rotation of the auger.

A squeezed water return port 122 is provide in the member 120, for return of water to the interior of the auger 75, once that water has been squeezed from ice auger passing through an expansion chamber to an ice compression nozzle as will be described hereinafter.

With reference to FIGS. 4 and 6, it will be seen that water in the interior 75 of the auger 72 is free to pass between the interior 75 of the auger and the exterior 109 thereof, via irrigation ports 107 through the auger wall 106.

It will be noted that the irrigation ports 107 are disposed just behind the trailing surface 113 of the flight 105, rather than near a leading surface 112 of the flight 105, in order to prevent ice that is being compressed and moved rightwardly along the auger 72, as shown in FIGS. 9 and 9A, and which ice is therefore being compressed, from being pressed into the ports 107, possibly clogging the same. On the downstream or trailing surface side of the auger 105, there is no compression of ice, and therefore no tendency of ice to be pressed into the ports 107, clogging the same.

It will thus be seen, with reference to FIGS. 9 and 9A, that ice particles 108 are compressed as ice is scraped from the cylindrical wall 70 and moved rightward toward a discharge end 117 of the auger 72, which ice increasingly becomes compressed as it approaches the flange 118 that rotates with the auger 72.

With reference now to FIG. 9B, it will be seen that a modified form of auger 272 may be provided, in which the auger wall 206 has a tapered exterior surface 219, such that the clearance between the wall 219 and the inner cylindrical surface 214 of the evaporator gradually increases as ice is delivered through zone 209, from left to right as viewed in FIG. 9B, in the direction of the arrow 211, toward the discharge end of the auger. During such movement, the flight 205, which has respective leading and trailing surfaces 212 and 213, scrapes ice being formed along the interior wall 214 of the evaporator. Thus, the taper between surfaces 219 and 214 will be at an angle "b" greater than 0°, as may be selected. Thus, the wall thickness of the auger wall 206 will gradually be reduced from left-to-right, as viewed in FIG. 9B.

Alternatively, particularly if the auger 272 is to be manufactured via a molding or casting technique, the wall thickness for the auger wall 206 could be maintained uniform, by having its interior surface defined by the phantom line 220 as shown in FIG. 9B parallel to the paper surface 219.

As shown in FIGS. 7 and 8, the flange 118 carries a paddle 125, having an ice-pushing paddle surface 126 which pushes ice particles 108 ahead of the paddle surface 126, as the auger rotates counterclockwise, as shown by the direction indicated by the arrow 127 in FIG. 8.

The ice particles 108, being pushed by the paddle 125, as the auger 72, flange 118 and paddle 125 move counterclockwise, as shown in FIG. 8, until the ice particles form an increased density in the zone 130, in which they actually become compacted into solid form.

As these compacted solid form ice particles 108 enter the zone 130, they approach an ice breakup device carried by the static diverter 63. The static diverter is mounted in the housing 57 by a suitable threaded connection 131, fixedly supported by pin 132, and comprises an angularly disposed breakup rod 133, that terminates at its lower end as shown in FIG. 8, in the breakup device 133', which will now be described.

The breakup device 133' engages moving, compacted solid form ice in zone 130 which is engaged by a breakup surface 134 that rides along the surface 106 of the auger, substantially in sliding contact therewith, as shown in FIGS. 7 and 8, for scraping the compacted solid form ice from the surface 106 of the auger, as the ice moves in the direction of the arrow 129 shown in FIG. 7. This disengages the ice from the surface 106 of the auger 72, wherein ice contacts the blunt surface 135 of the breakup device 133', such that solid form, compressed ice breaks into particles 136, which particles 136 are then diverted by angled diverter surface 135', toward the expansion chamber and compression means 138.

Continued counterclockwise movement of the paddle 125, in the direction shown by the arrow 127 in FIG. 8, then pushes those broken-up particles 136 upwardly, into a generally vertically disposed expansion chamber 137, as shown in FIG. 8, whereby expansion of theretofore compacted, solid form ice into particles is enabled, with the ice particles 136 then further passing upwardly into compression nozzle 138, which has an interior surface that is gradually converging, as shown in FIG. 8, so that ice particles are continually compressed as they go through the compression nozzle, to again be compressed into solid form ice, as ice nugget(s) prior to entering transport tube coupling 142.

Also, with reference to FIG. 8, it will be seen that the expansion chamber 137 is defined by an interior bore that is established by the internal diameter of a replaceable sleeve 139, that is generally cylindrical in configuration. It will also be noted that the tapered compression nozzle 138 terminates at its upper end in an output diameter defined by the opening 138'. In some instances, it is desirable to have a larger or smaller nugget size. Since it is the output diameter of the tapered nozzle 138 that determines the nugget size or nugget diameter, one may change the size of the nugget diameter simply by changing the nozzle 138 to have an output diameter that is larger or smaller, as may be desired. However, it has been found that the changing of the output diameter of the nozzle 138 can alter the hardness of the ice nugget. That is, if the output end 138' of the nozzle 138 is enlarged without changing the internal diameter of the expansion chamber 137, then the hardness of the nugget delivered outwardly from the nozzle 138 will be reduced. Similarly, it has been found that, if the output diameter 138' of the nozzle 138 is reduced, without any further change, then the nugget hardness delivered from the nozzle 138 will be increased. Accordingly, it is desirable to relate the output diameter 138' of the nozzle 138 to the internal diameter of the expansion chamber 137. To this end, the cylindrical sleeve 139 should also be replaced, to maintain a desired ratio between the internal diameter of the expansion chamber and the output diameter 138' of the nozzle 138. Thus, if it is desired to have larger nuggets, the nozzle 138 can be replaced accordingly such that its output end 138' is larger, and if that is to be done, the sleeve 139 that defines the internal diameter of the expansion chamber 137, would be replaced accordingly, with one having a larger interior diameter so that the hardness of the nugget would remain the same. Similarly, if it were desired to have a nugget that were of some other shape than circular in cross-section, the output end of the nozzle 138 may be provided with an oval, rectangular, or other shape and some corresponding alteration in the shape of the interior of the expansion chamber 137 may be similarly provided as may be desired, to facilitate the desired eventual shape and hardness of the nugget delivered from the nozzle 138.

There is a gap 140 between the expansion chamber 137 and the compression nozzle 138, which provides a means by which water may be squeezed out of the ice that is then being compressed. A water drain canal 141 is located in or adjacent to that gap 140, such that water that is being squeezed out of ice being compressed thereat, may pass downwardly through the housing 57, and back into the interior of the auger 72 via return port or conduit 122. The physical connection between the drain canal 141 and 122 is not specifically shown, but it will be understood that such are connected inside the housing 57.

As the rotation of the auger 72 drives ice up through the compression nozzle 138, it delivers the ice to a transport tube coupling 142, generally hollow and cylindrical, which is carried in a coupling housing 143. The coupling 142 is vertically movable in the housing 143, from its solid line position shown therein, to the phantom position shown at 144 in FIG. 8. The coupling 142 is slideably mounted in a cylindrical bushing 145, that has a plurality of vertically disposed keyways 146, 147 therein, as shown in FIG. 8.

Outside the keyways 146, 148, there is a compression spring 150, between the bushing 145 and the housing 143. The compression spring 150 is adapted for vertical compression.

Mounted to and carried by the exterior surface of the transport tube coupling 142, are a plurality of spring lower end abutments 151, 152, such that, when the coupling 142 is moved upwardly, due to an accumulation of ice therein that increases the upward force on the coupling, the upward movement of the coupling in the direction of the arrow 153, causes upward movement of the spring lower end abutments 151, 152, which engage the lower end of the compression spring 150, as the forces within the transport tube coupling 142 arising from accumulation of compressed ice therein overcome the resistance of the compression spring 150.

It will be understood that the ice discharge from the upper end of the transport tube coupling 142, goes through a conduit for delivery to an ice retaining means, storage chamber, or location of ice utilization, such as a retaining means 28, or the like.

As the transport tube coupling moves upwardly in the direction of the arrow 153, a flag member 155 carried thereby moves upwardly therewith.

With reference now to FIG. 10, it will be seen that the flag 155 is constructed as an "L"-shaped member, with a horizontal leg 156 and a vertical leg 157, with the vertical leg facing downwardly.

A sensor mechanism 158 is mounted on the exterior of the housing 143, as shown in FIG. 10 and includes a pair of upstanding legs 160 and 161, with a generally vertically disposed slot 162 therebetween. The leg 157 of the flag 155 is normally disposed in the slot 162 of the sensor 158, when ice accumulation inside the coupling 142 has not yet reached a force level such as would compress the spring 150 and cause upward movement of the coupling 142.

During the normal operation, ice nuggets being delivered from the coupling 142 pass through the transport tube 27 to the ice retaining means 28 with minimal effort, regardless of the length of the tube 27. For example, even when the tube 27 is over 150 foot long, and regardless of its vertical delivery height (not shown), which could be, for example, 20 feet or more high, the ice nuggets, having been formed upon the natural break-up during their passage through the nozzle 142, or an ice nugget cylinder thereof having been broken into separate nuggets due to a bend such as that 37 in the tube 27, the nuggets will nevertheless pass into the ice retaining means 28 in the form of separate nuggets. When the ice retaining means 28 becomes filled, the nuggets will stack up and fill the transport tube 27, creating a pressure back-up will apply an axial force within the transport tube 27, sufficient to cause compression of the spring 150 to shut down the operation of the apparatus, by means which are described hereinafter. Additionally, in the event of a jamming of ice nuggets within the transport tube 27, the upward movement of the coupling 142 as will be described hereinafter, and its sensor device 158, will serve as a detection means for any jamming that my occur in the transport tube.

Thus, when ice nugget(s) accumulate within the coupling 142, such causes upward movement of the coupling 142 in the direction of the arrow 153 in FIG. 8, such that when the coupling moves toward its phantom position 144 thereof, the flag 155 likewise moves upwardly with the coupling 142, from the full line positions therefore indicated in FIGS. 8 and 10, to the phantom positions indicated in FIGS. 8 and 10.

With reference now to FIGS. 11 and 12, it will be seen that the sensor device 158 includes a sender photocell device 163 and a receiver photocell device 164, normally having an appropriate voltage applied thereto across electrical contacts 165 and 166, through appropriate resistors $R^1$ and $R^2$. When the depending leg 157 of the flag 155 blocks transmission of an infrared or other signal from the sender photocell 163, from reaching the receiver photocell 164, the motor 44 as shown in FIG. 4 continues to operate as described above. However, when the leg 157 of the flag 155 is removed from blocking signal between sender and receiver photocells 163, 164, as shown in FIG. 12, and a signal is received by the receiver photocell 164, then that signal is communicated via electric lines 167, 168 that are connected to a switch 160, as shown in FIG. 4, which switch 160 controls the operation of the auger rotation motor 44, thereby moving the switch 160 from the full line position therefore shown in FIG. 4, to the phantom line position, in which the switch is open and operation of the motor 44 is discontinued.

Thereafter, when the forces of ice nuggets against the spring 150 become alleviated, and the spring 150 overcomes those compression forces, the coupling 142 returns to its full line position illustrated in FIG. 8, and the flag 155 returns to its full line position illustrated in FIG. 10, blocking signal transmission between photocell components 163 and 164, thereby actuating the switch 170 to its normally closed position as shown in FIG. 4, and operation of the auger drive motor 44 is resumed.

With reference now to FIGS. 5 and 13 through 16, the control of water level 86 within the reservoir 46 will now be discussed.

It is desirable to maintain the level 86 of water within the reservoir 46 within prescribed upper and lower limits. A representative electrical control of water level 86 in reservoir 46 will now be described. Alternatively, a mechanical control of water level 86, such as, but not limited to, a float valve type of water level control could be utilized.

When the water level 86 in the reservoir 46 is above the lower end of the normal low water level rod 91, but below the lower end of the normal high water level rod 94, and no additional water is needed to fill the reservoir 46, the water inlet solenoid 43 is in the closed position shown in FIG. 13 due to a spring within the solenoid (not shown), and its valve 170, carried by a movable core of the solenoid 43, is in a full line position as shown in FIG. 13, blocking the flow of water from the water inlet feed 171, to the water inlet line 48 of the reservoir 46, through the water valve housing 172.

When the water level 86 drops below the lower end of rod 91, the wires 93 and 90, respectively, connecting the rods 91 and 87, respectively, operating through control circuit 173 cause a closed circuit, such that the thus energized solenoid 47 moves the slideable valve member 170 leftward, to the phantom line position illustrated in FIG. 13, allowing water to flow from water inlet feed 171, through the valve housing 172, to water inlet line 48. This will continue until water reaches the desired level, such as that 86 shown in FIG. 5, such that the circuit between rod 91 and the common rod 87 becomes completed, using the water within the reservoir 46 to complete the circuit, whereby the valve 170 will return to the full line shut-off position shown in FIG. 13, once again discontinuing the supply of water to line 48.

When it is desired to drain the reservoir 46 for flushing or cleaning, the solenoid 51 is actuated due to completion of the electric circuit between the common rod 87 and the rod 94, such that the wires 96 and 90, respectively, connecting the rods 94 and 87 respectively, operating through control circuit 180, will actuate the solenoid 51, to move the valve 182 from its full line position blocking discharge of water from reservoir discharge line 52, in the direction of arrow 184, to drain line 1 83, whereby the valve 182 will be moved to the phantom line position 185, against the force of a spring (not shown) inside the solenoid 51, which spring normally urges the valve 182 toward the full line position shown in FIG. 14 and the reservoir 46 will be drained. After the water has been drained from the reservoir 46 via drain line 52, the water level 86 in the reservoir 46 drops, to later be filled, in the manner described above, after flushing or cleaning.

It will thus be seen that the solenoids 47 and 51, together with the circuitry provided by the appropriate electrically connected rods within the reservoir 46, will operate to maintain a water level 86 within the reservoir 46, between the lower ends of the rods 91 and 94.

With reference to FIG. 15, a low water level alarm rod 97 within reservoir 46 is electrically connected via electric line 100 to a control circuit 190, with the common rod 87 likewise being connected to the control circuit 190 via electric line 90, such that, should the water level within the reservoir 46 drop below the lower end of the low water level alarm rod 97, the control circuit 190 will cause a switch therein to open, shutting off the auger drive motor 44, and optionally simultaneously actuating an audible alarm 191, so that operator maintenance is notified.

Similarly, with reference to FIG. 16, should the high water level alarm rod 101 become part of the circuit between rod 101 and the common rod 87, through a water level sufficiently high to reach the lower end of rod 101, then the control circuit 192 will cause a switch within the circuit 192 to be actuated, opening the circuit such that motor 44 for driving the auger likewise stops, and an optional audible alarm 193 is actuated, likewise triggering operator maintenance.

Operation

In accordance with this invention, a refrigeration cycle similar to that described above with respect to FIG. 1 operates to provide refrigerant into an inlet 64 of the evaporator 56 as shown in FIG. 4, in which it circulates through the helical passageway 68 to the outlet 66, to cool the interior of the cylindrical wall surface 70, so that water freezes on the surface 70.

The auger motor 44 drives the horizontally disposed auger 72. Water from the reservoir 46 floods the interior 75 of the hollow auger 72, such that water is free to pass through the openings 107 through the auger wall, such that the entirety of the evaporator cylindrical surface 70 may be used for the formation of ice thereon.

The ice is scraped off the wall 70 by means of the cutting edge 111 of the auger, and the ice is pushed forwardly or rightwardly as viewed in FIG. 9 compressed between the leading ice-engaging surface 112 of the auger flight 105 and the flange 118 at the right-most end of the auger as shown in FIG. 9, so that it accumulates as shown in FIG. 8, as the auger rotates in a counter-clockwise direction as indicated by the arrow 127, such that the ice particles that are scraped from the cylinder wall become compacted as shown in FIG. 9.

The compacted ice is delivered to the statically disposed breakup rod 133, and is engaged by the breakup surface 134 thereof that rides along the surface 106 of the auger. The disengaged ice then contacts the blunt surface 135 of the breakup device 113 whereby particles 136 are then diverted by the angled diverter surface 135'.

Continued rotation of the auger pushes ice particles into the compression nozzle 138, whereby water is squeezed therefrom, which water can return via drain canal 141 back into the interior of the auger.

The ice particles inside the nozzle 138 are again compressed into solid form, and leave discharge end 138' as nugget(s) of a desired hardness.

The solid form ice is delivered via transport tube coupling 142 to a site of storage or use.

In the event that ice nuggets accumulate in the transport tube and coupling 142 with sufficient force, the transport coupling 142 may be pushed vertically upwardly inside bushing 145, compressing the spring 150, such that the transport tube 142 moves from its full line position, in the direction 153 indicated by the arrow, to the phantom position 144 shown in FIG. 8.

Such upward movement of the coupling 142 moves an L-shaped flag 155 upwardly therewith, such that its blocking presence between sender and receiver photocell components 163 and 164 as shown in FIG. 11 is broken, as the flag 155 moves to a position as indicated in FIG. 12, such that the rotational drive to the motor 144 of the auger is discontinued by opening of a switch 160 in the motor drive circuit, as shown in FIG. 4, and the motor drive for the compressor means 30 is discontinued, thereby discontinuing the refrigerant drive for the refrigeration system.

As shown in FIGS. 5, 13 and 14, the water level 86 in the reservoir 46 is controlled, to normally be at a level that is between the lower end of rod 91 and the lower end of rod 94, such that solenoids 47 and 51 respectively control the water inlet and outlet to the reservoir 46, by means of respective control circuits 173 and 180 which open or close valves 170 or 182, as earlier described.

High and low water level alarm rods 101 and 97, when actuated, can discontinue operation of the auger motor 44 by means of appropriate control circuitry 190, 192, as described above with respect to FIGS. 15 and 16.

It will thus be seen that the objects of the present invention are satisfied by the operation of the ice making apparatus in accordance with this invention.

It will be apparent from the foregoing that various modifications may be made in the details of construction, as well as in the use and operation of the ice making apparatus in accordance with this invention, all within the spirit and scope of the invention as defined in the appended claims.

What is claimed is:

1. An ice making apparatus for making ice of the nugget-forming type from ice shavings that are compacted, comprising:

(a) a refrigeration system for providing refrigerant to a freezing chamber of the hollow cylinder type;

(b) a freezing chamber with a generally hollow cylindrical inner wall and means for receiving water therein for forming ice on said cylindrical inner wall;

(c) a rotatable ice auger sized to fit inside said freezing chamber and comprising means for scraping ice formed on the wall of said chamber and conveying the ice from the wall of said chamber, along said rotatable auger, to ice compression means:

(d) means to cause rotation of said ice auger;

(e) means for supplying water to said freezing chamber;

(f) ice compression means for receiving ice from said freezing chamber and compressing it into compacted solid form while squeezing water therefrom; and (g) said ice compression means including a flange carried by said auger for rotation therewith and extending generally radially outwardly thereof.

2. The ice making apparatus of claim 1, wherein said means for scraping ice and said flange together comprise means for absorbing axial thrust resulting from ice compression.

3. The ice making apparatus of claim 1, including water conduit means for returning water squeezed out of ice by said ice compression means, to said freezing chamber.

4. An ice making apparatus for making ice of the nugget-forming type from ice shavings that are compacted, comprising:

(a) a refrigeration system for providing refrigerant to a freezing chamber of the hollow cylinder type;

(b) a freezing chamber with a generally hollow cylindrical inner wall and means for receiving water therein for forming ice on said cylindrical inner wall;

(c) a rotatable ice auger sized to fit inside said freezing chamber and comprising means for scraping ice formed on the wall of said chamber and conveying the ice from the wall of said chamber, along said rotatable auger, to ice compression means;

(d) means to cause rotation of said ice auger;

(e) means for supplying water to said freezing chamber;

(f) ice compression means toward a discharge end of the rotatable auger for receiving ice from said freezing chamber and ice breakup means and compressing it into compacted solid form while squeezing water therefrom; and (g) ice breakup means prior to the ice compression means, for engaging compacted solid form ice conveyed toward the discharge end of the rotatable auger and breaking up the compacted solid form ice into smaller ice particles prior to the ice being delivered to the ice compression means.

5. The ice making apparatus of claim 4, wherein said ice breakup means includes an ice diverter for diverting ice particles that are broken up, into an ice expansion chamber.

6. An ice making apparatus for making ice of the nugget-forming type from ice shavings that are compacted, comprising:

(a) a refrigeration system for providing refrigerant to a freezing chamber of the hollow cylinder type;

(b) a freezing chamber with a generally hollow cylindrical inner wall and means for receiving water therein for forming ice on said cylindrical inner wall;

(c) a rotatable ice auger sized to lit inside said freezing chamber and comprising means for scraping ice formed on the wall of said chamber and conveying the ice from the wall of said chamber, along said rotatable auger, to ice compression means;

(d) means to cause rotation of said ice auger;

(e) means for supplying water to said freezing chamber;

(f) ice compression means toward a discharge end of the rotatable auger for receiving ice from said freezing chamber and compressing it into compacted solid form while squeezing water therefrom; and (g) ice breakup means for engaging compacted solid form ice conveyed toward the discharge end of the rotatable auger and breaking up the compacted solid form ice into smaller ice particles wherein said ice compression means includes a flange carried by said auger for rotation therewith and extending generally outwardly thereof; and wherein said ice breakup means is located adjacent said rotatable flange and is statically positioned relative to said rotatable flange, whereby moving compacted solid form ice is contacted by said ice breakup means.

7. An ice making apparatus for making ice of the nugget-forming type from ice shavings that are compacted, comprising:

(a) a refrigeration system for providing refrigerant to a freezing chamber of the hollow cylinder type;

(b) a freezing chamber with a generally hollow cylindrical inner wall and means for receiving water therein for forming ice on said cylindrical inner wall;

(c) a rotatable ice auger sized to fit inside said freezing chamber and comprising means for scraping ice formed on the wall of said chamber and conveying the ice from the wall of said chamber, along said rotatable auger, to ice compression means;

(d) means to cause rotation of said ice auger;

(e) means for supplying water to said freezing chamber;

(f) ice compression means toward a discharge end of the rotatable auger for receiving ice from said freezing chamber and compressing it into compacted solid form while squeezing water therefrom; and (g) ice breakup means for engaging compacted solid form ice conveyed toward the discharge end of the rotatable auger and breaking up the compacted solid form ice into smaller ice particles wherein said ice compression means includes a flange carried by said auger for rotation therewith and extending generally outwardly thereof wherein said ice compression means includes paddle means carried by said rotatable auger adjacent said flange at said discharge end of the auger, for cooperating with said flange to form and push ice into compacted solid form ice at the discharge end of the auger.

8. The ice making apparatus of claim 7, and wherein said ice breakup means is located adjacent said rotatable flange and is statically positioned relative to said rotatable flange, whereby moving compacted solid form ice is contacted by said ice breakup means, and wherein said paddle means comprises means for pushing compacted solid form ice toward said ice breakup means.

9. The ice making apparatus of claim 5, including an expansion chamber for receiving broken up ice particles diverted by said ice diverter and allowing the ice particles to accumulate and aggregate therein into an expanded aggregate size.

10. The ice making apparatus of claim 9, including an ice compression nozzle for receiving aggregated ice particles from said expansion chamber and compressing them into solid shapes.

11. The ice making apparatus of claim 10, including water drain means associated with said compression nozzle for receiving water squeezed from the ice particles.

12. The ice making apparatus of claim 11, including means for delivering water from said compression nozzle and returning the water to said freezing chamber.

13. The ice making apparatus of claim 11, said compression nozzle and said expansion chamber being spaced apart, defining a gap means; with said water drain means communicating with said gap means for receiving water squeezed from ice particles, through said gap means.

14. The ice making apparatus of claim 4, wherein said ice breakup means includes means for scraping compacted solid form ice from said auger.

15. The ice making apparatus of claim 14, wherein said ice breakup means includes an ice diverter for diverting ice particles that are broken up, into and ice expansion chamber.

16. A method of making ice nugget(s) from ice shavings that are compacted, comprising the steps of:

(a) providing a refrigeration system that provides refrigerant to a freezing chamber;

(b) providing a freezing chamber having a generally hollow cylindrical inner wall;

(c) providing water to the freezing chamber for forming ice on the cylindrical inner wall of the freezing chamber;

(d) scraping the ice formed on the inner wall of the cylindrical freezing chamber by means of an ice auger, and conveying the ice thus formed along a rotatable auger, while rotating the auger;

(e) compressing the ice received from the freezing chamber into compacted solid form while squeezing water therefrom;

(f) breaking up the compacted solid form ice and delivering it into an expansion chamber; and (g) delivering the ice from the expansion chamber into a nozzle having a discharge end that has a smaller cross-section than an inlet end of the nozzle.

17. The method of claim 16, including the steps of selectively changing the cross-sectional discharge dimension of the nozzle and the cross-section of the expansion chamber to maintain substantially the same hardness for nugget(s) discharged from the nozzle.

18. A method of making ice nugget(s) from ice shavings that are compacted, comprising the steps of:

(a) providing a refrigeration system that provides refrigerant to a freezing chamber;

(b) providing a freezing chamber having a generally hollow cylindrical inner wall;

(c) providing water to the freezing chamber for forming ice on the cylindrical inner wall of the freezing chamber;

(d) scraping the ice formed on the inner wall of the cylindrical freezing chamber by means of an ice auger, and conveying the ice thus formed along a rotatable auger, while rotating the auger;

(e) compressing the ice received from the freezing chamber into compacted solid form while squeezing water therefrom;

(f) breaking up the compacted solid form ice and delivering it into an expansion chamber; and (g) delivering the ice from the expansion chamber into a nozzle having a discharge end that has a smaller cross-section than an inlet end of the nozzle including the steps of replacing the nozzle and expansion chamber with ones of selective cross-sectional sizes and/or shapes, to produce nugget(s) of correspondingly desired sizes and/or shapes.

* * * * *